US008466331B2

(12) United States Patent
Watanabe et al.

(10) Patent No.: US 8,466,331 B2
(45) Date of Patent: Jun. 18, 2013

(54) APPARATUS AND METHOD FOR GASIFYING GAS HYDRATE PELLET

(75) Inventors: Shigeru Watanabe, Tokyo (JP); Shinji Imai, Hiroshima (JP); Kazuhiko Shinagawa, Hiroshima (JP)

(73) Assignees: Mitsui Engineering & Shipbuilding Co., Ltd., Tokyo (JP); The Chugoku Electric Power Co., Inc., Hiroshima (JP)

( * ) Notice: Subject to any disclaimer, the term of this patent is extended or adjusted under 35 U.S.C. 154(b) by 507 days.

(21) Appl. No.: 12/735,633

(22) PCT Filed: Mar. 27, 2009

(86) PCT No.: PCT/JP2009/056377

§ 371 (c)(1), (2), (4) Date: Aug. 4, 2010

(87) PCT Pub. No.: WO2009/119839

PCT Pub. Date: Oct. 1, 2009

(65) Prior Publication Data

US 2010/0325955 A1 Dec. 30, 2010

(30) Foreign Application Priority Data

Mar. 28, 2008 (JP) ..... 2008-088788

(51) Int. Cl.

| | |
|---|---|
| ***C07C 9/00*** | (2006.01) |
| ***F17C 7/00*** | (2006.01) |
| ***F17C 9/02*** | (2006.01) |
| ***C01B 3/32*** | (2006.01) |

(52) U.S. Cl.

USPC ..... 585/15; 48/127.3; 62/54.2; 62/54.3

(58) Field of Classification Search

USPC ..... 48/127.3; 585/15; 62/54.2, 54.3

See application file for complete search history.

(56) References Cited

U.S. PATENT DOCUMENTS

| | | | | |
|---|---|---|---|---|
| 4,147,456 | A * | 4/1979 | Klass | 405/210 |
| 6,028,235 | A * | 2/2000 | Heinemann et al. | 585/15 |
| 6,082,118 | A * | 7/2000 | Endrizzi et al. | 62/46.1 |

FOREIGN PATENT DOCUMENTS

| | | | |
|---|---|---|---|
| JP | 2000-304196 | A | 11/2000 |
| JP | 2003322296 | A * | 11/2003 |
| JP | 2004-075849 | A | 3/2004 |

(Continued)

*Primary Examiner* — Matthew Merkling

(74) *Attorney, Agent, or Firm* — Jacobson Holman PLLC

(57) ABSTRACT

A gasification apparatus is provided which enables gas hydrate pellets to be transported and gasified in the same vessel and enables a gas to be generated by pellet decomposition in a controlled amount. The apparatus is free from bridging. The apparatus includes a heat-in-saluted vessel main body and, disposed therein, a tubular structure which is open at the top and bottom. This tubular structure holds therein gas hydrate pellets obtained by compression-molding a gas hydrate produced by the hydration reaction of a raw-material gas with raw-material water. The tubular structure becomes wider in diameter from the upper opening toward the lower opening. A channel for passing a heat carrier therethrough has been disposed between the lower end of the tubular structure and the inner bottom surface of the vessel main body. The apparatus is further equipped, between the tubular structure and the inner wall surface of the vessel main body, with a nozzle which ejects the heat carrier in a circumferential direction for the vessel main body. The vessel main body has a discharge pipe for discharging the heat carrier ejected from the nozzle, the discharge pipe projecting upright from the inner bottom surface of the vessel main body.

6 Claims, 7 Drawing Sheets

FOREIGN PATENT DOCUMENTS

| | | | | |
|---|---|---|---|---|
| JP | 2006-138349 | A | | 6/2006 |
| JP | 2006-160841 | A | | 6/2006 |
| JP | 2006-348193 | A | | 12/2006 |
| JP | 2007084619 | A | * | 4/2007 |
| JP | 2008-069264 | A | | 3/2008 |
| JP | 2008-274130 | A | | 11/2008 |

* cited by examiner

APPARATUS AND METHOD FOR GASIFYING GAS HYDRATE PELLET

This is a national stage of PCT/JP09/056377 filed Mar. 27, 2009 and published in Japanese, which has a priority of Japanese no. 2008-088788 filed Mar. 28, 2008, hereby incorporated by reference.

TECHNICAL FIELD

The present invention relates to a gasifier for carrying and gasifying a gas hydrate pellet and to a method therefor.

BACKGROUND ART

Among fuel gases, particularly, natural gas (a gas mixture mainly consisting of methane gas, propane gas, or the like), when in a form of liquefied natural gas, has a volume reduced down to 1/600th of that in its gaseous state. Accordingly, natural gas is transported in the form of liquefied natural gas (hereinafter, LNG) from a producing area to a consuming area or other areas. An LNG carrier equipped with a tank covered and surrounded by a heat-insulating material is used for the transportation.

However, aforementioned LNG has an extremely low boiling point of −162° C., and has a characteristic that LNG rapidly evaporates as the temperature increases. Thus, it is necessary to keep LNG under the extremely low temperature condition during transportation. For this reason, a dedicated container having a great cold-reserving ability is required therefore.

In recent years, as a form of fuel gas, attention has been paid to a gas hydrate that can be transported stably at a milder cooling temperature than that for above-described LNG. This gas hydrate is formed as follows. Specifically, raw material gas such as natural gas and raw material water are brought into gas-liquid contact at a temperature of approximately 0 to 5° C. under a high atmospheric pressure of approximately 3 to 5 MPa. Then, hydration reaction takes place to form a gas hydrate. In the gas hydrate, molecules of natural gas or the like are trapped in a lattice formed of aggregated multiple water molecules.

In order to keep a gas hydrate stable under atmospheric pressure, the gas hydrate needs to be stored at approximately −80° C. or below under equilibrium. Meanwhile, the gas hydrate has a property unique to hydrates, i.e., a so-called "self-preservation effect" that the gas hydrate is relatively stable at a temperature around −20° C. which is higher than the equilibrium temperature. Because of this self-preservation effect, the gas hydrate has a superb characteristic that the gas hydrate can be stored or transported over an extended period under a far milder atmosphere than that for LNG, i.e., at approximately −20° C. to −10° C. under atmospheric pressure.

Furthermore, for example, a natural gas hydrate (hereinafter, NGH), when in a form of NGH, has a volume approximately 1/170th of that in its gaseous form. Although having a volume reduction ratio lower than that of LNG, NGH does not need to be kept at such an extremely low temperature of −162° C. as in the case of LNG. Moreover, the NGH can be stored or transported relatively stably over an extended period under atmospheric pressure. Furthermore, the NGH does not require a storage container as highly durable and highly heat-insulating as that for LGN. Thus, a transport ship, cargo ship, and the like can be utilized after being reconstructed for NGH transportation, saving the cost for constructing a dedicated ship therefore, and the like.

On the other hand, a gas hydrate such as NGH is formed in a powder snow-like form, and accordingly has problems of a low bulk density and also a poor handling property. For this reason, as a way of decreasing the surface area and also increasing the bulk density, such a gas hydrate is compression-molded into a shape of almond, lens, sphere, or the like. However, a gas hydrate pellet obtained by compression molding as described above has an improved decomposition resistance. For this reason, methods for efficiently decomposing and gasifying such a gas hydrate have been proposed.

[In-Water Stirring Method]

FIG. 6 shows a scheme of a continuous introduction-type gassifier 41 (see, for example, Patent Document 1). Pellets 31 are sequentially introduced into a container 11 through a supply inlet 12, and brought into contact with water 32 whose temperature has kept at 1° C. to 5° C. to decompose the pellets for gasification. Moreover, the continuous introduction-type gasifier 41 includes a heater 18 to maintain the aforementioned temperature by heating the water 32, since the introduced pallets 31 are normally around −25° C. to −5° C. Furthermore, a stirrer 42 is provided to stir the water 32 in the container 11 to increase the contact efficiency between the water 32 and the pellets 31 so that the heat can be rapidly transferred therebetween, and that the decomposition of the pellets 31 can be accelerated. Additionally, a discharge pipe 14 is provided to maintain the water level in the container 11 at a predetermined height, since the gas hydrate includes hydration water contained at the time of hydration reaction with raw material water and releases the water and a gas upon decomposition.

Problems of the stirring method are that a crushing and stirring unit is needed, and that additional power consumption is required. Moreover, for stirring, a large amount of water must be present in a space around pellets, and accordingly the size of the gasification tank tends to be large.

In addition, a transfer installation is needed for transferring the pellets 31 from a storage·transportation container thereof to the gasifier 41, increasing the size of the entire gasifier 41 facility.

[Water Spraying Method]

FIG. 7 shows a gasifier 43 (see, for example, Patent Document 2.) allowing the transportation and gasification of pellets 31. In the gasifier 43, water 32 is sprayed onto the gas hydrate pellets 31 stored in a container 11.

This gasifier 43 enables the storage·transportation and gasification of the pellets 31 to take place in the same apparatus, making the whole apparatus compact. Meanwhile, as the gasification proceeds, the amount of the pellets 31 filled in the container 11 is successively decreased, leading to a problem that the amount of gas generated is likely to vary. This makes it difficult to achieve stable gas supply.

Moreover, there is another problem that, even when the spraying of the water 32 is stopped, the decomposition of the pellets 31 cannot be stopped, since the sprayed water 32 reaches all over the pellets 31 filled in the container 11.

[Immersing Method]

FIG. 8 shows a gasifier 45 (see, for example, Patent Document 3.) allowing the transportation and gasification of pellets 31. The pellets 31 are filled into a container 11 and transported. The pellets 31 are decomposed by introducing water 32 into the container 11. This gasifier 45 is designed so that the water 32 will be introduced from a bottom portion of the container 11. By controlling the water level in the container 11, the amount of the pellets 31 immersed in the water 32 is adjusted. Furthermore, the amount of gas generated is controlled by the temperature and the amount of water introduced.

The pellets 31 located on the bottom portion side of the container 11 are immersed in the water 32, whereas the pellets 31 located at the middle portion and top portion of the container 11 never comes into contact with the water 32. Thereby, the amount of gas generated can be accurately controlled by the adjustment of the water level. Thus, a gas can be supplied stably to the outside.

However, in this gasifier 45, when the pellets 31 on the bottom portion side of the container 11 are decomposed, a cavity is formed as shown in FIG. 5. As a result, there is a problem that the pellets 31 at the other portions are not gasified due to a so-called "bridge phenomenon" in which the pellets 31 are not supplied downward any more.

This bridge phenomenon occurs because the pellets 31 that are in contact with an inner wall of the container 11 adhere to the inner wall, and because the pellets 31 are supported at the wall surface by receiving a compression force of their own weights.

In order to eliminate a bridge 33 formed in the container 11, some counter-measure needs to be taken such as provision of breaking means for physically breaking the bridge 33 in the container 11. Such installation of a mechanism such as a hammer for breaking the bridge 33 in the container 11 means a less loading space for the pellets 31.

Meanwhile, in a case where the breaking means is not installed in the container 11, the container 11 has to be opened every time the bridge 33 is to be broken. As a result, there are problems that a gas is escaped concurrently with the opening of the container 11, and that the opening operation is labor consuming.

Patent Document 1: Japanese patent application Kokai publication No. 2004-75849

Patent Document 2: Japanese patent application Kokai publication No. 2006-160841

Patent Document 3: Japanese patent application Kokai publication No. 2006-138349

DISCLOSURE OF THE INVENTION

Problem To Be Solved By the Invention

In view of the above conventional techniques, an abject of the present invention is to provide a gasifier: which is capable of carrying·asifying a gas hydrate pellet in a single container; which controls the amount of gas generated by decomposition of the pellet; and furthermore which does not allow a bridge phenomenon to occur.

Means For Solving the Problem

A gasifier for gas hydrate pellet according to the present invention is structured as follows.

1) The gasifier for a gas hydrate pellet according to the present invention is characterized by including: a container main body which is insulated and hermetically sealed; a pellet-filling cylindrical body provided inside the container main body; a nozzle through which a heat medium for decomposing a gas hydrate pellet held in the cylindrical body is supplied; a gas-supply pipe through which a gas generated by decomposition of the gas hydrate is supplied to an outside; and a discharge pipe through which the heat medium is discharged. The gasifier is characterized as follows. The pellet-filling cylindrical body has a side wall or outer wall surface formed with such a slippage angle to reduce its contact resistance with the gas hydrate pellet held therein. A disposition space for the nozzle through which the heat medium is jetted is formed between an outer wall surface of the cylindrical body and an inner wall surface of the container main body. A flow space for the heat medium is formed between a lower edge of the cylindrical body and a bottom surface of the container main body. The heat medium is jetted in a circumferential direction of the disposition space for the nozzle.

2) The gasifier is characterized as follows. Friction reducing means for reducing the contact resistance with the pellet is formed on an inner wall surface of the cylindrical body holding the gas hydrate pellet. The friction reducing means is any of a plurality of protruding strips extending vertically, a plurality of convexes and concaves, and a polytetrafluoroethylene resin coating film.

3) The gasifier is characterized as follows. The discharge pipe for the heat medium provided in the bottom surface on an inner side of the container main body includes a discharge outlet formed at a tip end of the discharge pipe, the discharge outlet being for discharging the heat medium. The discharge pipe is provided in a manner that the tip end thereof is vertically movable.

4) The gasifier is characterized in that the container main body is formed so as to be capable of cargo transportation.

Moreover, a gasifying method for a gas hydrate pellet according to the present invention is structured as follows.

5) The method is characterized by including the steps of: jetting a heat medium for decomposing a gas hydrate pellet in a circumferential direction of the inner wall surface of the container main body; forming a swirl flow of the heat medium on a bottom surface side of the container main body by the heat medium thus jetted; and bringing the heat medium into contact with the gas hydrate pellet by the swirl flow for decomposition.

6) The method is characterized in that a decomposition speed of the gas hydrate pellet is adjusted by adjusting a liquid surface height of the heat medium reserved on the bottom surface side of the container main body.

Effects of the Invention

1) A cylindrical main body 15 is provided inside a container 11 for carrying gas hydrate pellets, the cylindrical main body 15 having a reverse-tapering form, that is, its diameter gradually increases toward the bottom. This makes it hard to transmit a compression force to the pellets 31, and eliminates the formation of a bridge 33.

As a result, the gas hydrate pellets are stably supplied to a lower portion of the container 11, stabilizing the gasification and achieving stable gas supply to the outside.

2) Moreover, a stripe body is formed on the inner wall surface of the cylindrical body 15. Thereby, the pellets 31 that are in contact with the inner wall surface are prevented from being adhered to the inner wall surface. Furthermore, the inner wall surface of the cylindrical body 15 is covered by polytetrafluoroethylene. Thereby, the adhesion is further prevented, eliminating the formation of the bridge 33.

3) When water 32 is supplied into the container 11, the water 32 is supplied through a nozzle 19 provided at the lower portion of the container 11. Accordingly, a swirl flow 22 of the water 32 is formed inside the container 11. This swirl flow improves the contact efficiency between the pellets 31 and the water 32, and thereby the gasification is conducted efficiently. Furthermore, by immersing the pellets 31, a filled condition is created. The water 32 flows through pellet pores, and the apparent flow rate is increased, providing a higher heat transfer effect.

Additionally, the swirl flow 22 makes the temperature of the water 32 uniform, preventing the pellets 31 from being decomposed locally.

4) The nozzle 19 through which a heat medium 32 for decomposing the pellets 31 is provided in a nozzle installation space A between the container main body 11 and the pellet-filling cylindrical body 15, the heat medium 32 being jetted in the circumferential direction of the container main body 11. Thereby, the clogging of the nozzle 19 at the tip end side by the pellet 31 is prevented, and the immediate collision of the jetted heat medium 32 with the pellet 31 is also prevented. Accordingly, the preferable swirl flow 22 can be formed.

5) The water 32 is discharged from the container 11. This discharged water is heated and then returned to the container 11 again for cyclic utilization. Thus, a gasifier 10 alone can supply a gas without additional fresh water from the outside.

More specifically, simply loading the gasifier 10 on transportation means such as a truck and connecting a gas-supply pipe 13 of the gasifier 10 to a gas-supply installation enables the gas to be supplied.

EXPLANATION OF REFERENCE SYMBOLS

Figure 1:
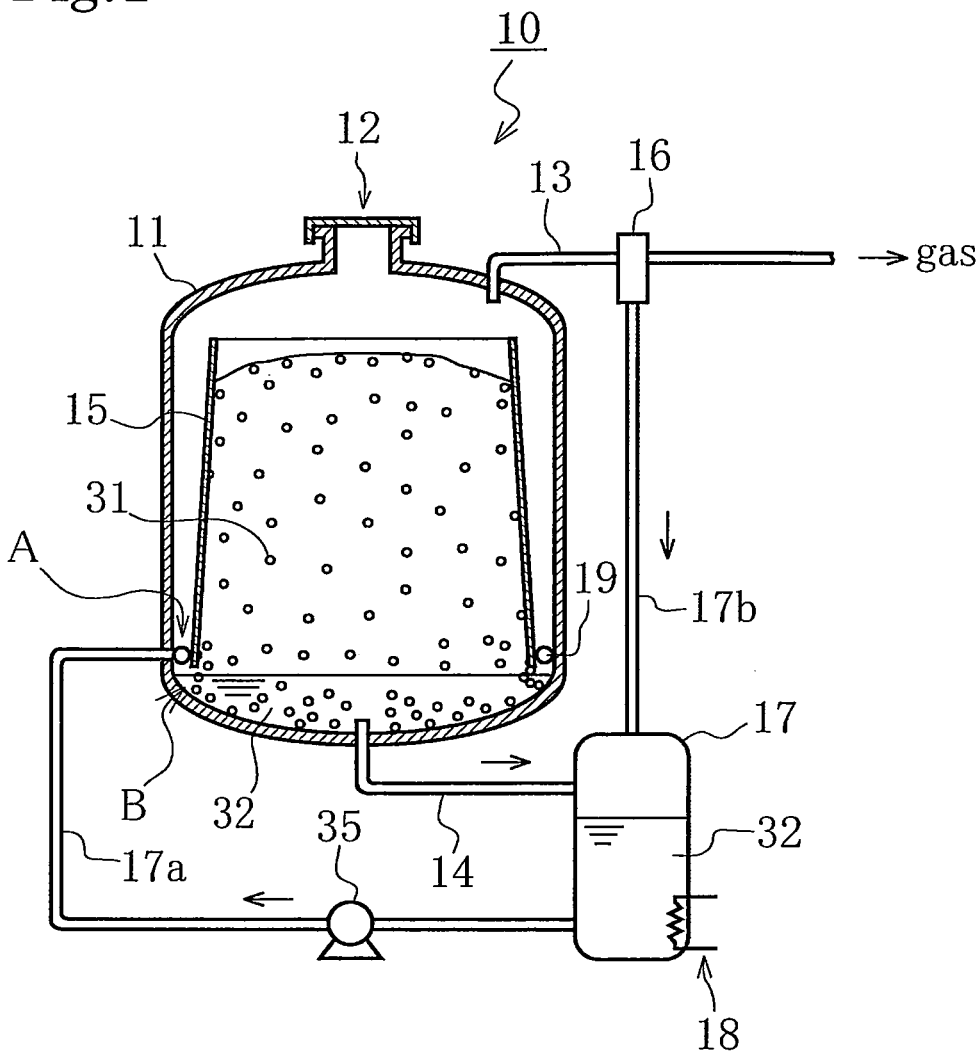
FIG. 1 is a schematic configuration diagram (cross-sectional view) of a gasifier for a gas hydrate pellet according to the present invention.

10 Gasifier
11 Container
12 Supply inlet
13 Gas-discharge pipe
14 Discharge pipe
15 Cylindrical body
16 Gas-liquid separator
17 Reservoir tank
18 Heater
19 Nozzle
21 Water flow
22 Swirl flow
23 Stripe body
31 Pellet
32 Water

BEST MODES FOR CARRYING OUT THE INVENTION

Hereinafter, description will be given of a gasifier for a gas hydrate pellet according to the present invention with the drawing.

Embodiment 1

As shown in FIG. 1, gasifier 10 for a gas hydrate pellet according to the present invention includes a cylindrical body 15 disposed in a container 11. The cylindrical body 15 has a tapering form, so that its diameter gradually increases toward the bottom. Gas hydrate pellets 31 introduced through a supply inlet 12 at the upper portion of the container 11 are stored inside the cylindrical body 15. This cylindrical body 15 is made of a metal such as aluminum and stainless steel or made of a resin. The inner wall surface of the cylindrical body 15, which comes into contact with the pellets 31, is embossed so as to reduce the contact resistance with the pellets 31.

At a lower portion of the container 11, multiple nozzles 19 are provided to jet water 32. The water 32 is jetted through these nozzles 19 in the same circumferential direction, and the water 32 is swirled in the container 11. Moreover, a discharge pipe 14 is provided upright at the center of the bottom portion of the container 11 so as to discharge the water 32 in the container 11. The water 32 thus discharged flows into a reservoir tank 17 equipped with a heater 18. The water 32 is heated by the heater 18, and then jetted again into the container 11 through the nozzles 19 via a pump 35.

A gas-discharge pipe 13 is provided in an upper portion of the container 11 to discharge a gas outside the apparatus, the gas being generated by decomposition of the pellets 31. A gas-liquid separator 16 is provided to the gas-discharge pipe 13. This gas-liquid separator 16 separates water in the gas from the gas. The water is returned to the reservoir tank 17, while the gas is supplied to an external installation such as a supply installation.

In FIG. 1, the nozzles 19 are installed in a nozzle installation space A formed between the container 11 and the cylindrical body 15 so as to form a swirl flow 22 without disturbing the flow of the water 32 jetted from the nozzles 19. To put it differently, this prevents the flow disturbance of the jetted water 32 due to the contact of the pellet 31 with the tip end of the nozzle 19. Moreover, a flow space B is formed, where the water 32 thus jetted flows swiftly toward the bottom surface of the container 11.

In the gasifier 10 thus structured for the gas hydrate pellets 31, the pellets 31 produced by a pellet production installation are introduced into the container 11 through the supply inlet 12. The container 11 filled with the pellets 31 is loaded on carrying means carried to a gas supply installation.

Figure 2:
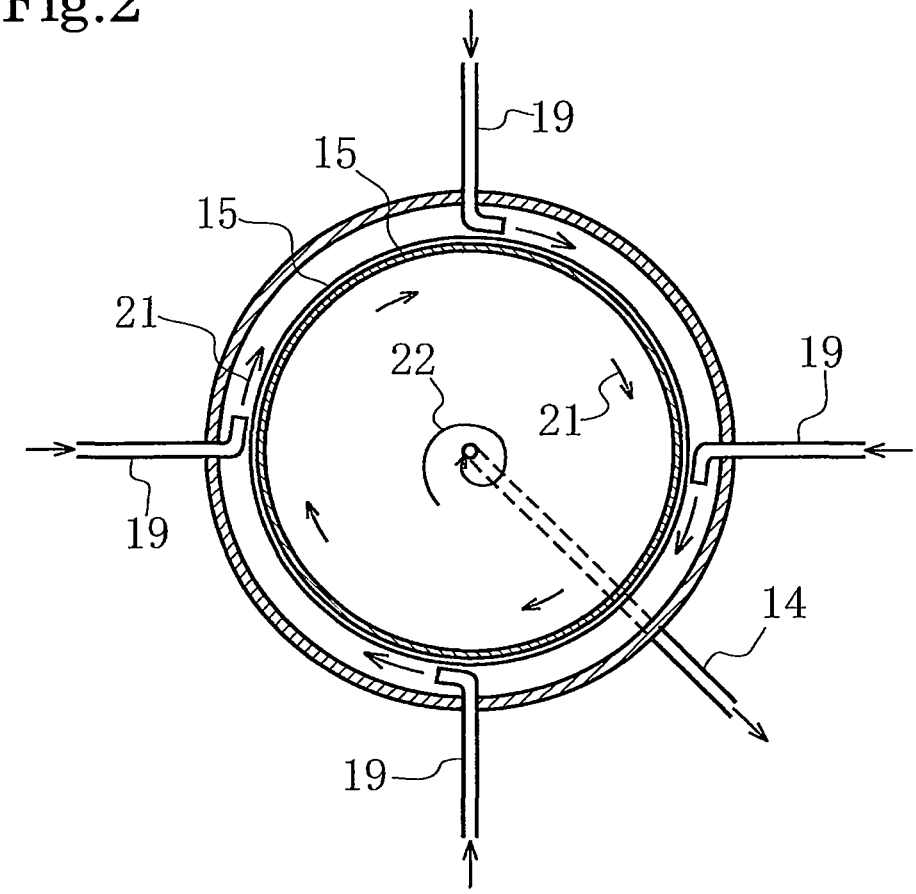
FIG. 2 is a schematic configuration diagram (horizontal cross-sectional view) of the gasifier for a gas hydrate pellet according to the present invention.

In the gasifier 10 carried to a destination, for example, the water 32 heated at 1° C. to 5° C. by the heater 18 is pressure-pumped by the pump 35 and jetted into the container 11 through the nozzles 19. By the jet flow of the water 32 thus jetted, the swirl flow 32 of the water 32 is formed in the container 11 as shown in FIG. 2, and the pellets 31 are decomposed. The water 32 is discharged through the discharge pipe 14 provided upright at the bottom portion of the container 11, and flows into the reservoir tank 17. As shown in FIG. 2, the water 21 is jetted through the multiple nozzles 19 in the same circumferential direction, and this jet flow forms the swirl flow 22. The swirl flow 22 makes the temperature distribution of the water 32 uniform.

Figure 4:
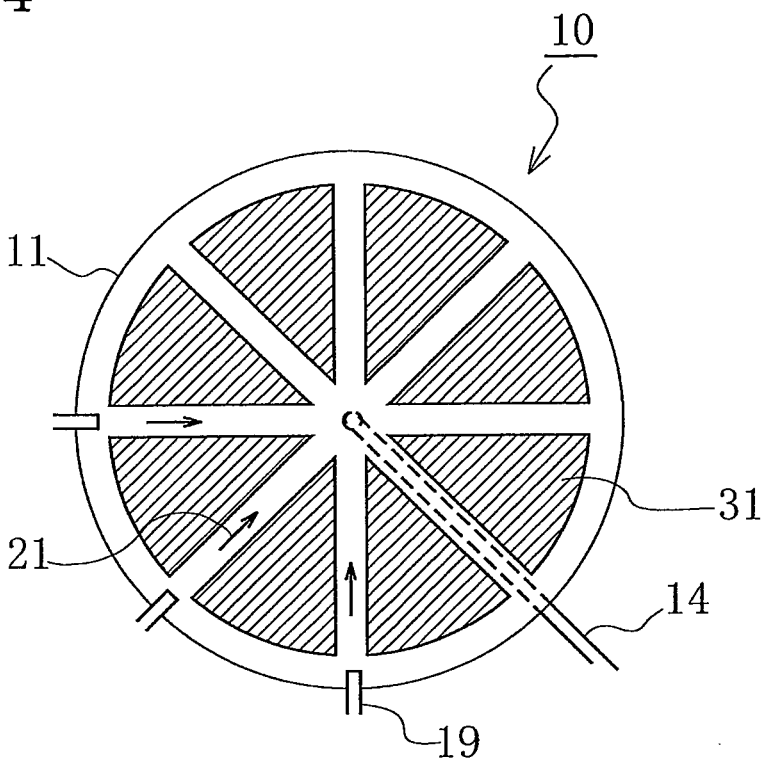
FIG. 4 is a drawing showing a state where a hydrate is decomposed when a swirl flow is not present.
Figure 5:
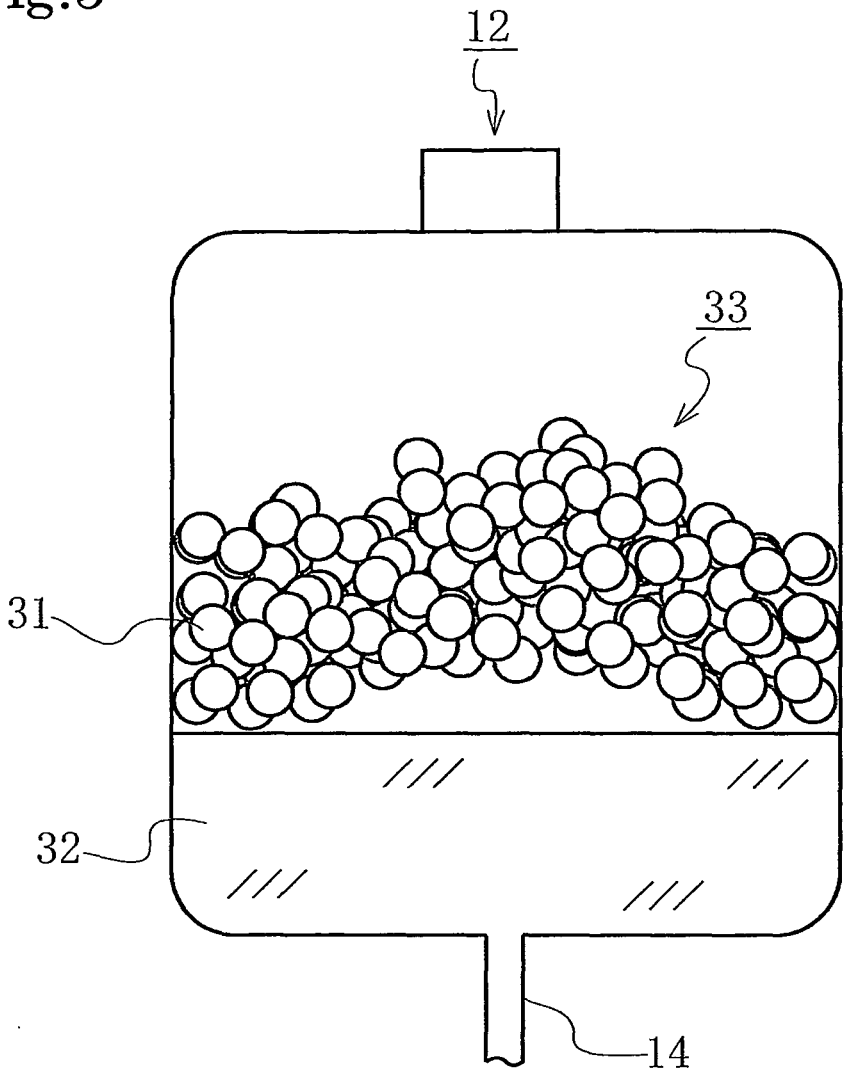
FIG. 5 is a schematic diagram of a bridge.
Figure 6:
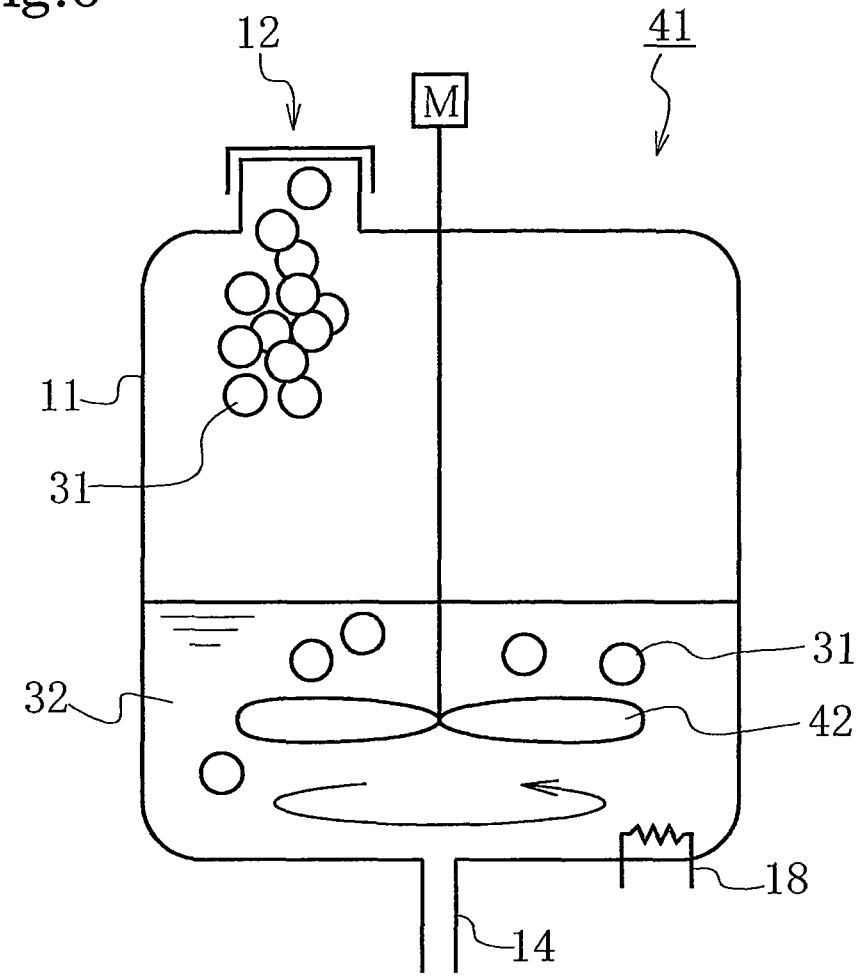
FIG. 6 is a schematic diagram of a conventional gasifier (in-water stirring method).
Figure 7:
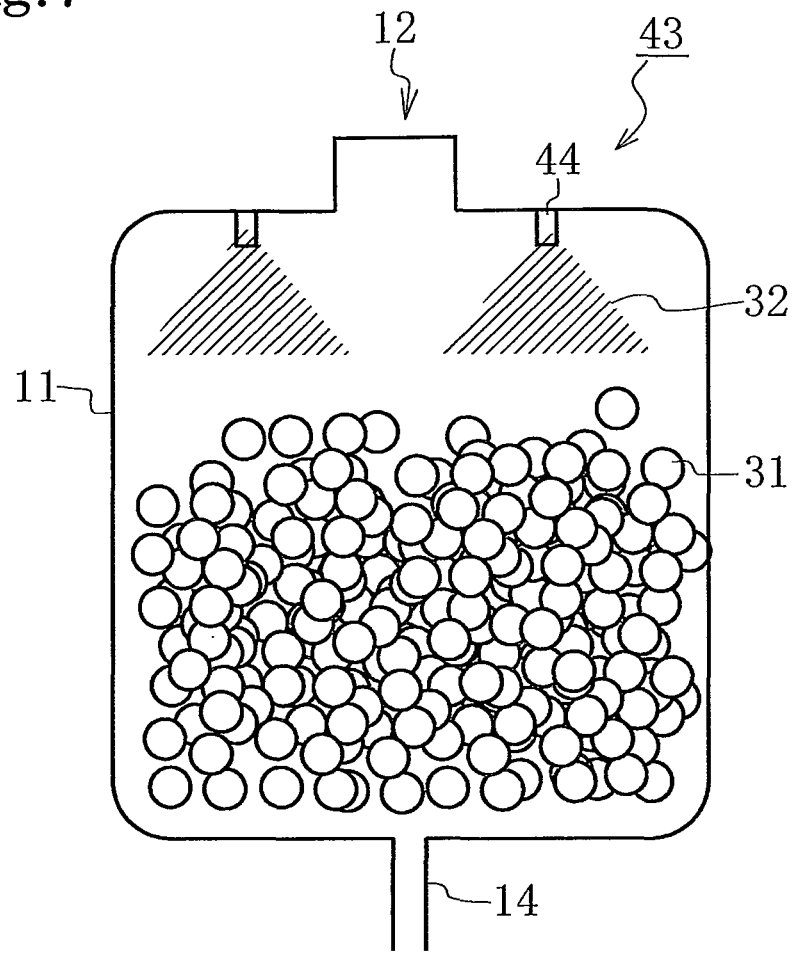
FIG. 7 is a schematic diagram of a conventional gasifier (water spraying method).
Figure 8:
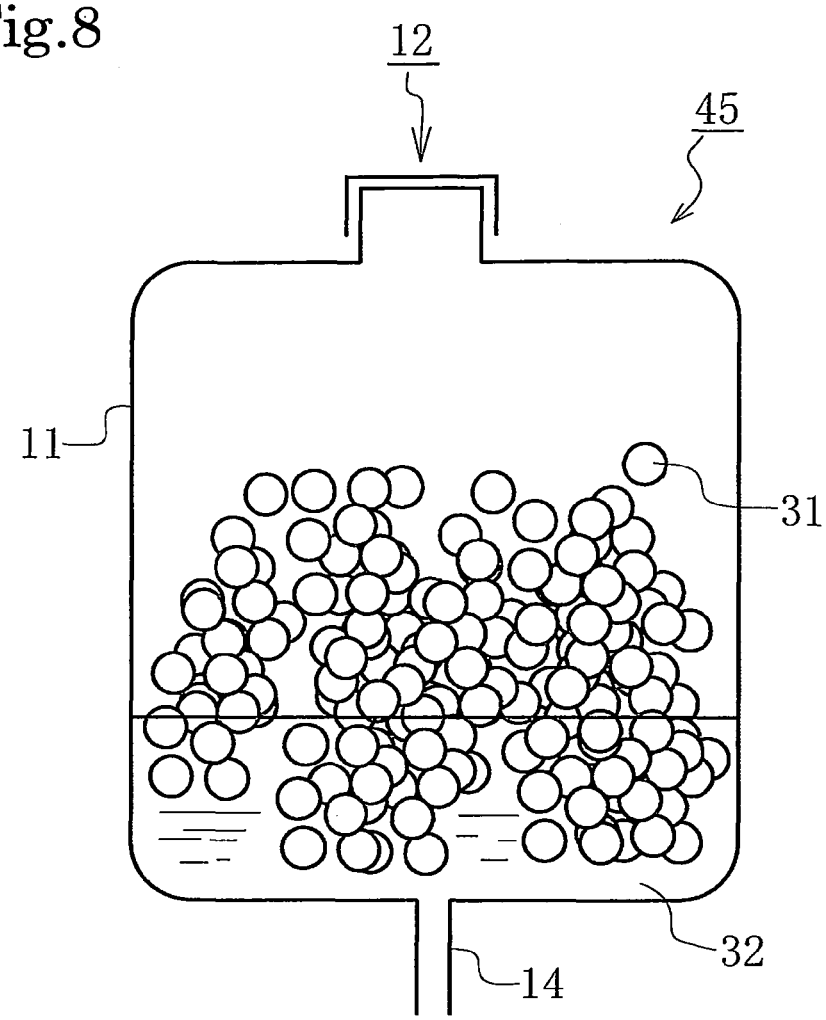
FIG. 8 is a schematic diagram of a conventional gasifier (immersing method).

Moreover, for example, when the swirl flow 22 is not present, some of the pellets 31 remain unmelted and are shaped into columnar forms as shown in FIG. 4, which causes a bridge 33 to be formed in some cases. By forming the swirl flow 22, in contrast, such an incident is prevented. FIG. 4 shows the unmelted pellets 31 when the multiple nozzles 19 are provided toward the center of the container 11.

The gas generated by decomposition of the pellets 31 is supplied to the external supply installation or the like through the gas-discharge pipe 13. Water generated by decomposition of the pellets 31 is discharged through the discharge pipe 14 to the reservoir tank 17 for reuse.

Embodiment 2

Figure 3:
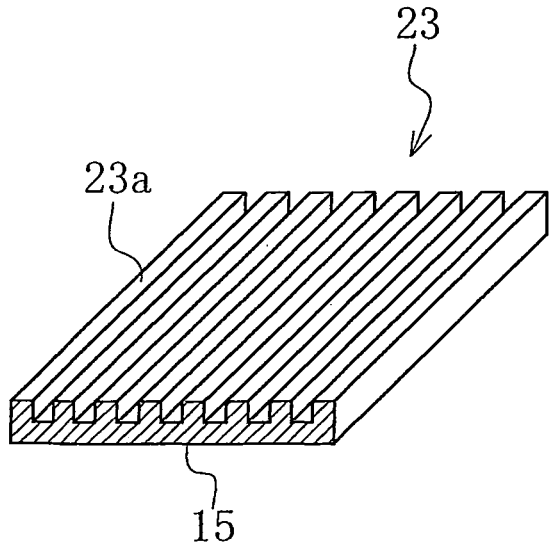
FIG. 3 is a drawing showing one example of a stripe body on a cylindrical body.

In a gasifier 10 of this embodiment, a stripe body 23 as shown in FIG. 3 is formed on the inner wall of a cylindrical body 15. The stripe body 23 further prevents adhesion between the pellets 31 and the inner wall of the cylindrical body 15. The inner wall of the cylindrical body 15 may be covered by polytetrafluoroethylene in addition to the stripe body 23. Alternatively, a waved plate such as a corrugated plate can be used as the inner wall of the cylindrical body 15.

Embodiment 3

Figure 9:
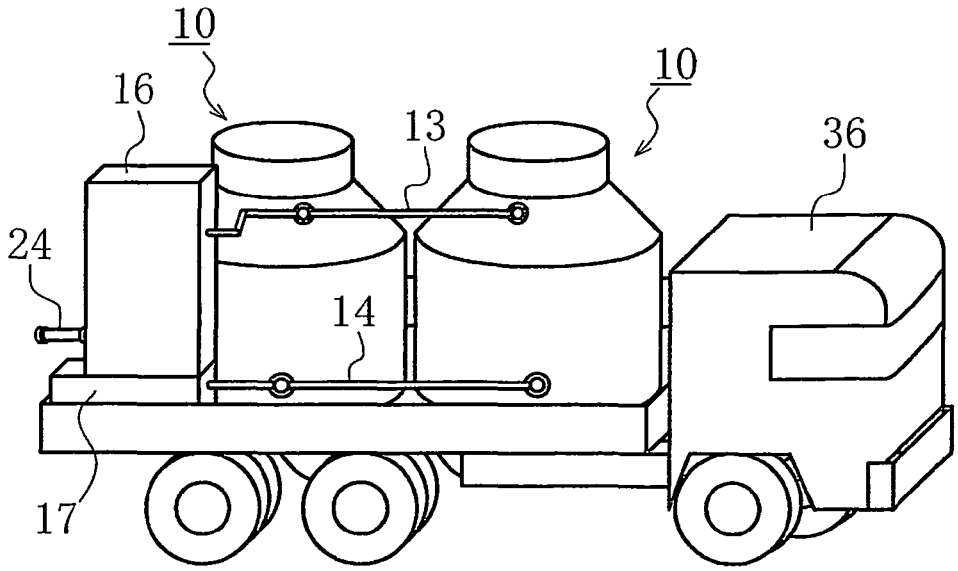
FIG. 9 is a drawing showing a transportation form of the gasifier for a gas hydrate pellet according to the present invention.

In this embodiment, a gasifier 10 is loaded on a truck 36 as shown in FIG. 9, allowing the transfer to a place where the gas supply is needed. For example, the gasifier 10 is transferred to a disaster area or an isolated island by the truck 36. A gas-supply pipe 24 is connected to equipment or the like that uses the gas as its fuel. Thus, the gas supply is achieved.

In the gasifier 10, a single container 11 serves as both a carrying container and a gasification container. Thus, gasification is conducted freely at the carrying destination for the gas supply.

The present invention provides a gasifier: which is capable of carrying·gasifying a gas hydrate pellet in a single container; which controls the amount of gas generated by decomposition of the pellet; and furthermore which does not allow a bridge phenomenon to occur.

INDUSTRIAL APPLICABILITY

A gasifier and gasifying method for a gas hydrate pellet according to the present invention provide a gasifier and a gasifying method which are capable of carrying·gasifying a gas hydrate pellet in a single container; which controls the amount of gas generated by decomposition of the pellet; and furthermore which does not allow a bridge phenomenon to occur. Thereby, stable gas supply from the gas hydrate pellet is achieved, and gasification can be conducted freely at a carrying destination for the gas supply.

What is claimed is:

1. A gasifier for a gas hydrate pellet characterized by comprising:

a container main body which is insulated and hermetically sealed;

a pellet-filling cylindrical body provided inside the container main body;

a nozzle through which a heat medium for decomposing a gas hydrate pellet held in the cylindrical body is supplied;

a gas-supply pipe through which a gas generated by decomposition of the gas hydrate is supplied to an outside; and a discharge pipe through which the heat medium is discharged, the gasifier characterized in that the pellet-filling cylindrical body has a side wall formed with such a slippage angle to reduce its contact resistance with the gas hydrate pellet held therein, a disposition space for the nozzle through which the heat medium is jetted is formed between an outer wall surface of the cylindrical body and an inner wall surface of the container main body, a flow space for the heat medium is formed between a lower edge of the cylindrical body and a bottom surface of the container main body, and the heat medium is jetted in a circumferential direction of the disposition space for the nozzle.

2. The gasifier for a gas hydrate pellet according to claim 1, characterized in that friction reducing means for reducing the contact resistance with the pellet is formed on an inner wall surface of the cylindrical body holding the gas hydrate pellet, and the friction reducing means is any of a plurality of protruding strips extending vertically, a plurality of convexes and concaves, and a resin coating film.

3. The gasifier for a gas hydrate pellet according to claim 1, characterized in that the discharge pipe for the heat medium provided in the bottom surface on an inner side of the container main body includes a discharge outlet formed at a tip end of the discharge pipe, the discharge outlet being for discharging the heat medium, and the discharge pipe is provided in a manner that the tip end thereof is vertically movable.

4. The gasifier for a gas hydrate pellet according to claim 1, characterized in that the container main body is formed so as to be capable of cargo transportation.

5. A gasifying method for the gasifier for a gas hydrate pellet according to claim 1, the method characterized by comprising the steps of:

jetting a heat medium for decomposing a gas hydrate pellet in a circumferential direction of the inner wall surface of the container main body;

forming a swirl flow of the heat medium on a bottom surface side of the container main body by the heat medium thus jetted; and bringing the heat medium into contact with the gas hydrate pellet by the swirl flow for decomposition.

6. The gasifying method for the gasifier for a gas hydrate pellet according to claim 5, characterized in that a decomposition speed of the gas hydrate pellet is adjusted by adjusting a liquid surface height of the heat medium reserved on the bottom surface side of the container main body.

* * * * *